United States Patent [19]

Ishimura

[11] Patent Number: 4,600,826

[45] Date of Patent: Jul. 15, 1986

[54] HEATING TIME CONTROL MEANS FOR A HEATING APPLIANCE

[75] Inventor: Yozo Ishimura, Kashihara, Japan

[73] Assignee: Matsushita Electric Industrial Co., Ltd., Kadoma, Japan

[21] Appl. No.: 626,836

[22] PCT Filed: Oct. 28, 1983

[86] PCT No.: PCT/JP83/00389

§ 371 Date: Jun. 26, 1984

§ 102(e) Date: Jun. 26, 1984

[87] PCT Pub. No.: WO84/01813

PCT Pub. Date: May 10, 1984

[30] Foreign Application Priority Data

| | | | |
|---|---|---|---|
| Nov. 5, 1982 | [JP] | Japan | 57-194947 |
| Nov. 5, 1982 | [JP] | Japan | 57-194948 |
| Nov. 5, 1982 | [JP] | Japan | 57-194949 |
| Nov. 5, 1982 | [JP] | Japan | 57-194950 |

[51] Int. Cl.[4] ..... H05B 6/68

[52] U.S. Cl. ..... 219/492; 219/10.55 B; 219/10.55 C; 200/38 FA; 99/325

[58] Field of Search ..... 219/10.55 B, 10.55 C, 219/492, 493; 200/38 FA, 38 A; 49/325

[56] References Cited

U.S. PATENT DOCUMENTS

| | | | |
|---|---|---|---|
| 3,736,799 | 6/1973 | Harris | 200/38 FA |
| 4,129,769 | 12/1978 | Takagi et al. | 219/10.55 B |
| 4,177,370 | 12/1979 | Otani | 219/10.55 B |

FOREIGN PATENT DOCUMENTS

| | | |
|---|---|---|
| 52-43143 | 4/1977 | Japan . |
| 52-35132 | 9/1977 | Japan . |
| 52-112135 | 9/1977 | Japan . |

*Primary Examiner*—Philip H. Leung

*Attorney, Agent, or Firm*—Wenderoth, Lind & Ponack

[57] ABSTRACT

By intermittently starting and stopping a timer motor of a timer which is a heating time setting device by means of an intermittent switch to turn on and off the power source, two speeds are obtained, and one timer may be used to set both a long time and a short time, and moreover when the timer is set for a long time, the input of heating means is also connected and disconnected so as to obtain a heating output which makes possible simmering or stewing.

4 Claims, 15 Drawing Figures

HEATING TIME CONTROL MEANS FOR A HEATING APPLIANCE

FIELD OF THE INVENTION

This invention relates to improvement of the means to control the heating time setting device and heating source in heating appliances for cooking such as electric oven and microwave ovens.

BACKGROUND OF THE INVENTION

For example, conventional high frequency heating appliances for cooking are very convenient cooking appliances capable of heating efficiently and rapidly because only the object to be heated, e.g. food, is heated by induction. Or, depending on the menu of cooking, it is also possible to heat for a long time at low output by controlling the high frequency output for thawing, egg dishes, or long and slow cooking food such as stew, and high frequency heating appliances with an output selector have been conventionally used and provide expected effects. In particular, since stewing requires a very long heating time at low output, the heating time setting is naturally very long. For instance, while a setting of 15 minutes or 20 minutes may be sufficient for the usual high frequency output induction heating at about 500 W or 600 W, a setting of about an hour is necessary for stewing because of heating at a high frequency output of about ⅓ of the usual heating, and it is very inconvenient if the conventional appliance permits a time setting of only 15 or 20 minutes.

In one of the conventional examples, as shown in FIG. 1, the object e.g. food, to be heated (not shown) is put on a turntable 2 in a heating compartment 1, the door 3 is closed, and a timer 4 for high output is set to a proper heating time according to a menu table 5 depending on the kind and size (weight) of the food, and the cooking start button 6 is pressed, and when the timer 4 expired, the cooking ends. In this arrangement, however, two timers are required, one for usual heating and the other for long-time setting for stewing.

One of such examples is shown in FIG. 2. There is a selector for high frequency output, and a timer 4 for high output and a timer 7 for low output are used. The heating time is set by the timer 4 where high output was needed, and by the timer 7 where low output is needed for stewing or the like.

Its circuit is shown in FIG. 3, in which a time switch 8 is turned on when the low output timer 7 is actuated, and the timer motor 9 for low output begins to rotate at the same time. In this operation, the time switch 8 remains closed until expiration.

As an attempt to solve this problem, a two-speed timer 10 has been used for setting both long time and short time. That is, as shown in FIG. 4, the time setting is divided at about 20 minutes, and a heating time of up to 20 minutes can be easily set on large graduations, and a longer time is set on small timer graduations which are operating time display graduations, so that the timer operating speed may be varied by an output selector button 13 in order to set a long time.

In the heating appliance for cooking having such design, however, when the operating speed of the timer motor is varied, a time lag occurs structurally, and a discrepancy of about two or five minutes occurs relative to the setting graduation due to the error between the angle of inducator 11 of the time switch for varying the operating speed and graduations 12 of two-speed timer 10, which results in poor finishing of the cooking due to the discrepancy of heating time as described above.

Yet, since the structure is extremely complicated as compared with that of one-speed timers, and the cost of parts is as high as for two timers and the quality is inferior because of the complicated structure. The only merit is saving of space in designing.

DISCLOSURE OF THE INVENTION

This invention makes it possible to heat and cook either in a short time or in a long time by means of only one timer, by varying the operating speed of the timer for setting the heating time and controlling the heating source by supplying the power to the timer motor either intermittently or continuously, and also by varying the heating output.

According to the present invention, the time graduations may be designed freely as compared with the conventional timer having a fixed constant speed timer motor, and the precision of setting time is enhanced by the electric control of the timer motor, so that heating and cooking with a particularly high precision can be achieved in high frequency heating appliances or the like.

DESCRIPTION OF THE PREFERRED EMBODIMENTS

In the following description, the object to be heated is described for purposes of illustration as food, and the heating is described in terms of cooking the food. The invention is not limited to heating of food for cooking, but extends to heating of any object to be heated.

A heating appliance for cooking according to a first embodiment of the present invention is shown in FIGS. 5 to 11. In this embodiment, a cam 15 is attached to a timer shaft 14 of a timer 10 which changes the operating speed in between two modes, and a microswitch 16 is mounted on to a plate on which the timer 10 is mounted.

Figure 1:
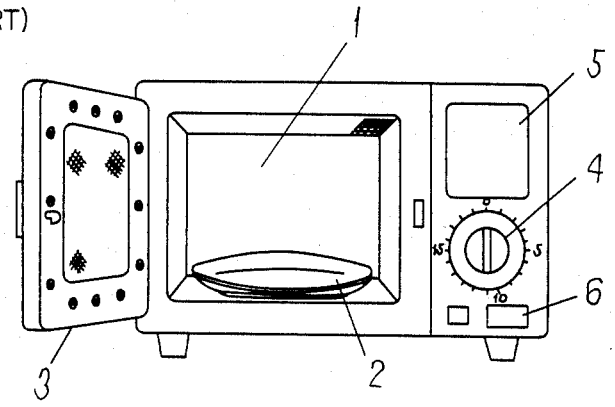
Fig. 1 (PRIOR ART)
FIG. 1 is a front view showing a prior art high frequency heating appliance with the door open.
Figure 2:
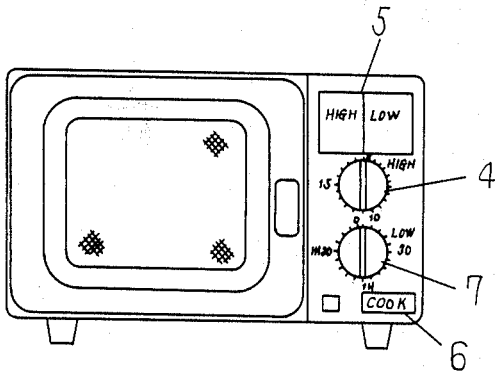
Fig. 2 (PRIOR ART)
FIG. 2 is a front view of another prior art high frequency heating appliance.
Figure 3:
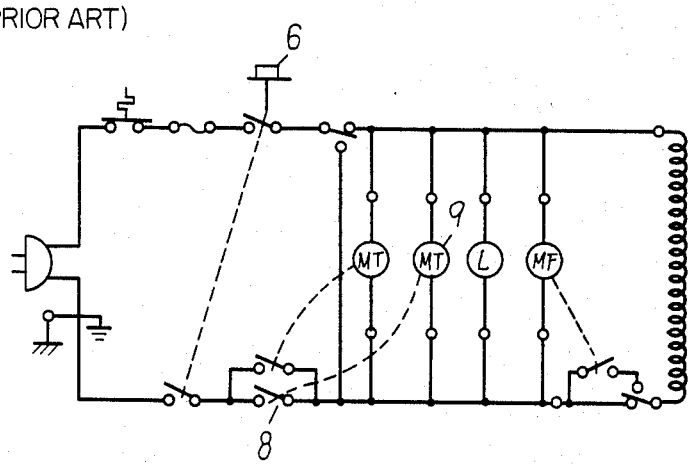
Fig. 3 (PRIOR ART)
FIG. 3 is a control circuit diagram for the appliance of FIG. 2.
Figure 4:
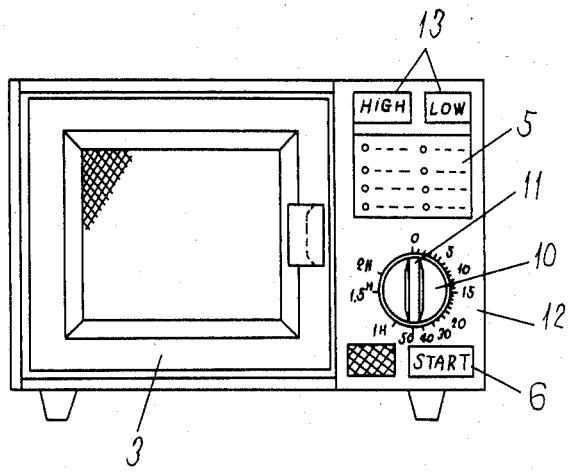
Fig. 4 (PRIOR ART)
FIG. 4 is a front view of a prior art high frequency heating appliance using a two-speed timer.
Figure 5:
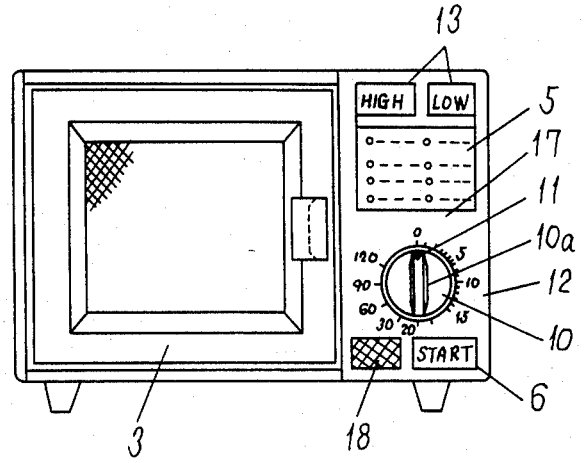
FIG. 5 is a front view of a heating appliance for cooking according to one of the embodiments of the present invention.

Referring first to FIG. 5, an operation panel 17 is located in the vicinity of a door 3 which closes the front side of the heating compartment in the main body being supported axially to open and close freely. This operation panel 17 accommodates a menu table 5 indicating the cooking time according to the dishes and cooking hints, a timer knob 10*a* for setting the cooking time, graduations 12 around the knob, an output selector 13 for selecting high frequency output, a cooking start button 6, a display lamp 18 to show that the cooking is in progress, and other conventional devices.

In this ordinary two-speed one-timer high frequency heating appliance (a microwave oven), the food F is put on a turntable 2 in a heating compartment 1, the door 3 is closed, the timer 10 is set to a proper heating time depending on the kind, size and weight of the food after selecting the output by the output selector 13, and the cooking start button 6 is pressed to start cooking, and when the timer 10 expires, the cooking ends.

Figure 6:
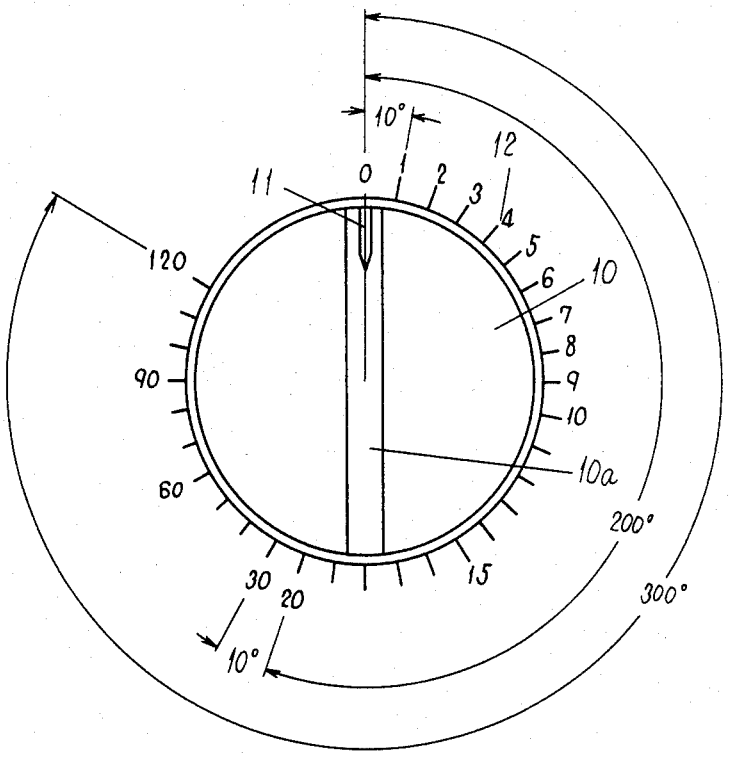
FIG. 6 is an enlarged front view of the timer knob of the same appliance.

Referring now to the graduations 12 of the timer 10, in FIG. 6, if the full scale of the operating angle of the timer 10 for the high frequency heating appliance is 300°, the range from angle 0° to 200° corresponds to 20 minutes, and one minute is equal to 10°, while the range from angle 200° to 300° corresponds to 100 minutes, and one minute is equal to 1°. That is, the scale is 1/10 of graduations per minute in the range from 0° to 200° (or ten times that from 0° to 200°).

Figure 7:
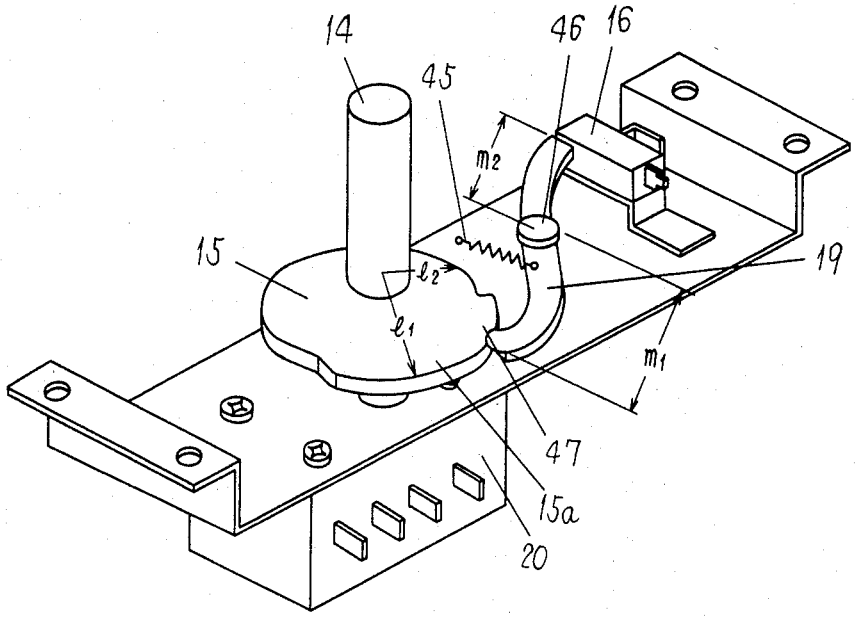
FIG. 7 is a perspective view showing the timer shaft, cam and lever of the same appliance.

Referring to the timer shaft 14, in FIG. 7, in the one timer 10 corresponding to the conventional high output timer, the power to the timer motor 20 is supplied continuously, as is conventional, in the range from angle 0° to 200°, and is supplied intermittently in the range from angle 200° to 300°. When the user turns the timer knob 10*a* and sets a time limit, the microswitch 16 is turned off by the cam 15 and lever 19 attached to the timer shaft 14. In the control circuit diagram shown in FIG. 8, the power is supplied to the contact a side of the microswitch 16, so that the timer motor 20 remains in ON state. That is, this is the range from "OFF" to "20" (angle 0° to 200°) in FIG. 6.

On the other hand, when the user further turns the timer knob 10*a* and sets a time limit, the microswitch 16 is turned on by the cam 15 and lever 19 attached to the timer shaft 14.

Figure 8:
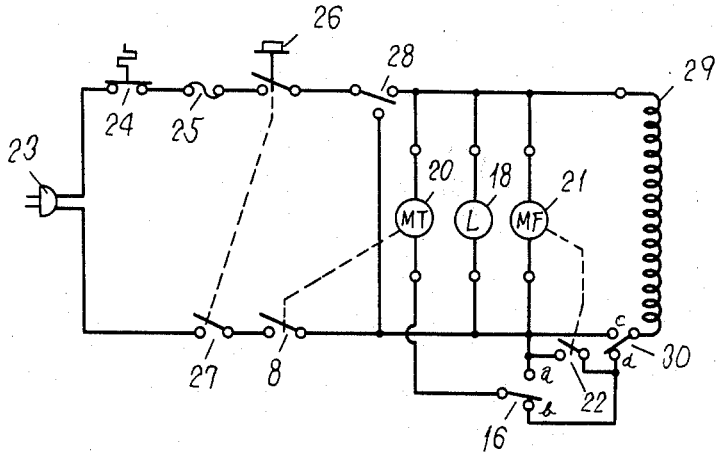
FIG. 8 is a control circuit diagram of the same appliance.

In FIG. 8, the power is supplied to the contact b side of the microswitch 16, and the timer motor 20 is operated intermittently by the connection and disconnection of an intermittent switch 22 which is turned on and off intermittently by the rotation of a fan motor 21. That is, this is the range from graduation "20" to "120" (angle 200° to 300°) in FIG. 6.

Describing now the control circuit according to FIG. 8, one of the lines of a power plug 23 is connected in series with a first latch switch 26 which is interlocked with an abnormal temperature rise preventive device 24 of the heating compartment 1, overcurrent preventive device (fuse) 25, and also serves as the switch to generate high frequency when the cooking start button 6 is pressed, and a door switch 28 which serves as the door switch to be interlocked with the opening and closing of the door 3 and as the switch for forming a short circuit to turn off the fuse 25 by monitoring an abnormal state (melting) of the first latch switch 26 and a second latch switch 27, and is also connected in parallel with the timer motor 20, display lamp 18 to indicate that cooking is in progress, fan motor 21 for cooling the magnetron, and transformer 29 for high frequency generation.

On the other hand, the other line of the plug is connected in series with the second latch switch 27, time switch 8 interlocked with timer motor 20, and contact c of output selector 13 for selecting the amount of high frequency output. The other line of the timer 20 is connected to the microswitch 16 for two speed selection. This microswitch 16 is connected parallel to the intermittent switch 22 which connects and disconnects the high frequency output (the primary input into transformer 29 for high frequency generation), and its contact b is connected with contact d of the output selector switch 30 which selects the output in response to pressing the output selector 13.

Concerning next the high frequency output selection (primary selection of transformer 29 for high frequency generation), when one line of the plug 23 is connected with the second latch switch 27, time switch 8, contact c of output selector switch 30, and transformer 29, the output is changed to the high side. And the high frequency output becomes low when one line of the plug 23 is connected with the second latch switch 27, time switch 8, intermittent switch 22, contact d of output selector switch 30, and transformer 29 for high frequency generation.

Thus, the speed selection of the timer 10 is not related with the output selector switch 30 for high frequency output, and two speeds of the timer 10 may be achieved by using the intermittent switch 22 for low high frequency output.

Figure 9:
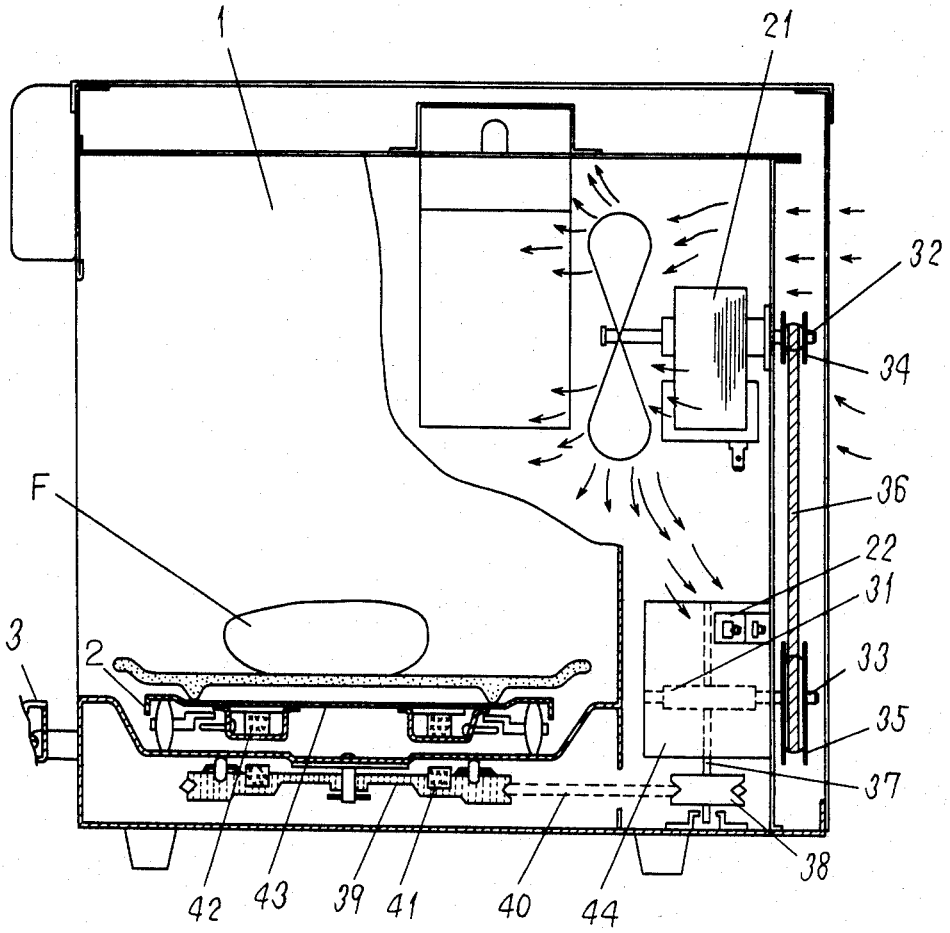
FIG. 9 is a side cross section of important parts of the same appliance.

An example of this construction is shown in FIG. 9, in which pulleys 34, 35 are fitted respectively on shafts 32, 33 of the worm gear 31 for converting the rotating force of the fan motor 21 for cooling the magnetron by 90°. A belt 36 is connected between these pulleys 34 and 35 the pulley 34 being mounted on the motor 21. Another belt 40 is applied between a pulley 38 provided on a transmission rod 37 and a rotating body 39 in order to transmit the rotating force of the motor 21 to the rotating body 39. When the rotating body 39 carrying a driving magnet 41 is put into rotation, a turntable 43 carrying a permanent magnet 42 follows the rotation of magnet 41. The intermittent switch 22 is provided in a gear box 44 in which a worm gear 31 is housed, and it is turned on and off by a cam (not shown) rotating in this box.

Figure 10A:
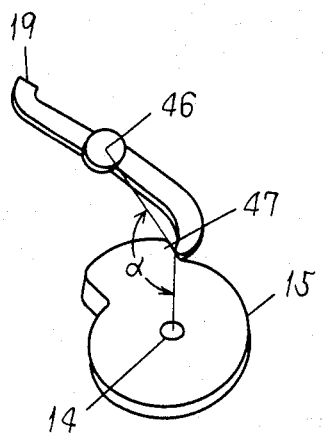
FIGS. 10*a* and 10*b* are a perspective view and a diagram for showing the operation of the cam and lever of the same appliance.
Figure 10B:
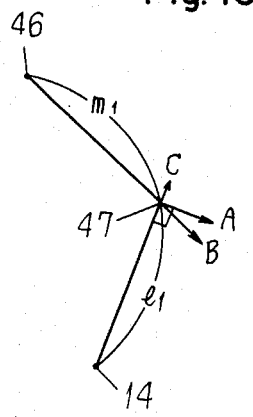

Referring now to FIGS. 7 and 10, the relation between the cam 15, lever 19, and the microswitch 16 is explained hereunder. In these figures, the cam 15 is set and fixed at a specified position, height and angle on the timer shaft 14. In particular, the cam part 15*a* (radius $l_1$ part) is situated at the side (angle 200° to 300° in FIG. 7) for turning on and off the power source of the timer motor 20. That is, from angle 0° to 200°, the cam 15 has a smaller radius $l_2$, and at this time on force is applied to the cam in the relation between the cam 15 and lever 19, and lever spring 45 of lever 19.

At the same time, the configuration of fulcrum shaft 46 of lever 19, microswitch 17 for two speed selection, and timer shaft 14 is designed as follows.

The angle $\alpha$ formed by the fulcrum shaft 46 of lever 19, operating point 47 of lever 19 and cam 15, and timer shaft 14 of timer 10 is set to be 90° or wider.

Therefore, the vector when the lever 19 rides over the operating point 47 is A>B>C as shown in FIG. 10, where A is the vector in the tangential direction of radius $l_1$, B is the vector of lever fulcrum and operating point direction, and C is the vector in the centrifugal direction of radius $l_1$, so that if the lever 19 rides over the cam 15 part it is smooth and the feel of operation is smooth.

Occurrence of fire due to overheating in the heating compartment may be almost completely prevented.

Figure 11:
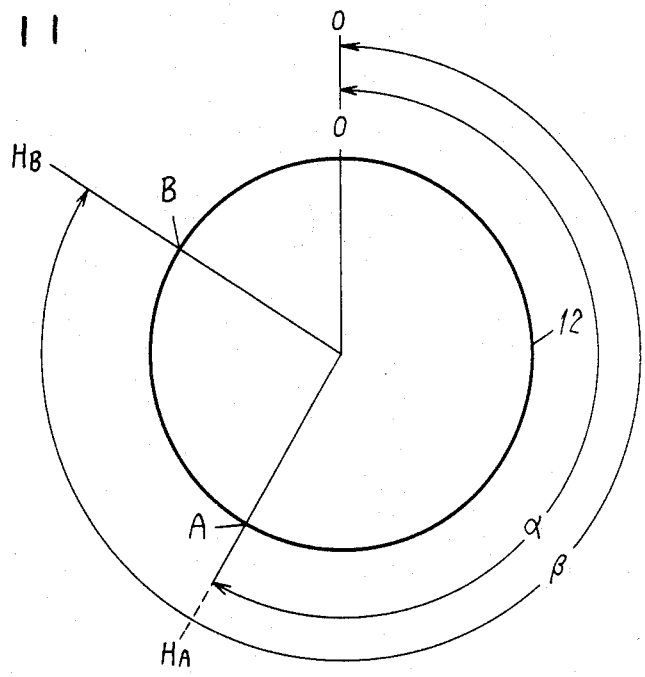
FIG. 11 is a drawing explaining the timer graduations and setting method of the same appliance.

FIG. 11 shows the method of setting the timer graduations for using one-speed timer in two speeds, in which the maximum rotating angle of the timer knob is point B and the speed change point of the timer motor 9 is point A. Supposing $\alpha$: rotating angle from zero to point A of timer knob $\beta$: maximum rotating angle from zero to point B of timer knob (300°)

$H_A$: set time of point A (20 minutes)

$H_B$: set time of point B (120 minutes)

$V_A$: timer speed from point A to zero $V_B$: timer speed from point B to zero (1/10 $V_A$), the graduation $\alpha$ of the timer knob for setting the high output is $$\alpha=[H_A]\times[V_A]\ldots \quad (1)$$

and the graduation of the timer knob for low output is $$\beta-\alpha=[H_B]\times[V_B]\ldots \quad (2)$$

Therefore, once the maximum rotating angle of the timer knob ($\beta=300°$) is set, since $\alpha+(\beta-\alpha)=\beta$, eqs. (1) (2) may be rewritten as $$V_A=\frac{300\times 10}{10\times H_A+[120-(H_A)]}=\frac{3000}{120+9H_A} \quad (3)$$

By multiplying eq. (3) by $[H_A]=20$, the value of $\alpha$ is obtained $$V_A\times H_A=\alpha=\frac{3000\times 20}{120+9\times 20}=200°$$

Thus, if one timer is used in two speeds, the graduations corresponding to low output timer and high output timer can be easily determined.

By this embodiment, the following effects will be obtained. When setting the heating means for a long time, that is when the speed of the timer motor 20 is slow, the power to the timer motor 20 is supplied intermittently, so that the timer graduations 12 may be freely designed, while a heating appliance for cooking excelling in timer precision is obtained at the same time.

Besides, regardless of the timer speed, the heating time of high output or low output is easy to set, and the ease of use is further improved. In addition, since the lever 19 is provided between the cam 15 and microswitch 16, the following effects are achieved as compared with the conventional construction in which the microswitch 16 was pressed only by the cam 15 without use of the lever 19.

(1) The operating direction of the lever 19 can be set so as to exert an operating force always in a specified actuator moving direction to the actuator of the microswitch 16, so that the durability of the microswitch 16 may be greatly increased, together with the enhancement of the reliability of the mechanism.

(2) Since the length of arm ($m_1$, $m_2$) of the lever 19 may be freely set, it is possible to ignore the force applied from the side on the timer shaft 14 of the timer 10, so that the incidence of fire due to interruption of the timer 10 may be assumed in the designing stage.

(3) The intermittent switch 22 for output selection of high frequency output may be used to slow down or quicken the speed of the timer motor 20 during rotation of the timer 10 regardless of the high frequency output, so that the timer 10 may be designed freely according to the cooking software, and since the speed of the timer motor 20 is changed over by the intermittent switch without using a special speed selector, it is economical and the mass production effect is great.

(4) Since the degree of freedom is very ample, such as the diameter of cam 15, position of the lever, length of the arm, position of the engagement point, and the angle, the number of types of timers 10 can be reduced, which also contributes to the mass producibility, and the cost of the timer 10 can be reduced, while its reliability is increased.

Furthermore, by using a one-speed timer 10 as a two-speed timer depending on the purpose of use in a simple structure, an easy-to-use heating appliance for cooking which is stable in both quality and performance can be provided at a low price.

Also by using a one-speed timer as a two-speed one, the mounting space and the assembling processes can be reduced, and since the power source of the timer motor 20 is designed to be turned on and off by the intermittent switch 22 which is operated by the cam 15 provided on the motor shaft 14 and the cam of the motor for driving the turntable, the graduations 12 of the timer may be arbitrarily designed.

Moreover, by the correspondence of one minute to 10° in the range of 0 to 20 minutes on the timer graduations 12, it is easy to set the cooking time, and the following cooking methods are possible by use of the intermittent switch 22, and it is very convenient.

| | Reheating | Cooking | Thawing | Simmering |
|---|---|---|---|---|
| Heating output | High | High | Low | Low |
| Timer range | 0~15 min | 0~15 min | 0~15 min | 30 min & over |

Figure 12:
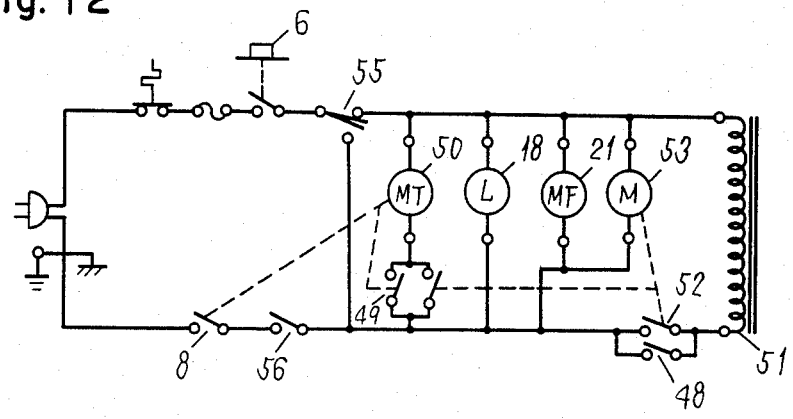
FIG. 12 is a control circuit diagram of a heating appliance for cooking according to a second example of the embodiments.

A second embodiment is described below with reference to FIG. 12. The timer 10 for high output continuously supplies power to the timer motor 50 shown in FIG. 12 by means of the timer selector switch 49 in FIG. 12 which is turned on by the cam 15 provided on the timer shaft 14 in FIG. 7, at the time of high output of high frequency waves as shown in FIG. 5, that is, when the timer knob 10*a* is turned and the high output side button 13 is pressed to close the contact A 48 in FIG. 12. Or when a low output of the high frequency is desired, that is, when the timer knob 10*a* is turned and the low output side button 13 in FIG. 5 is pressed, the timer selector switch 49 in FIG. 12 is turned off, and the intermittent switch 52 provided between the timer selector switch 49 and the primary side of the transformer 51 for high frequency generation is turned on and off, so that setting of a long time is made possible. Therefore, by setting the on/off cycle of the timer selector switch 49 and intermittent switch 52 as desired, any timer suited to a specific application may be set up. To control the operation of the timer selector switch 49 to turn on and off the power source of the timer motor 50, a cam is provided in a motor 53 which rotates and drives the turntable incorporated in the heating compartment 1, and the timer selector switch 49 and the intermittent switch 52 is turned on and off by this cam.

Figure 13:
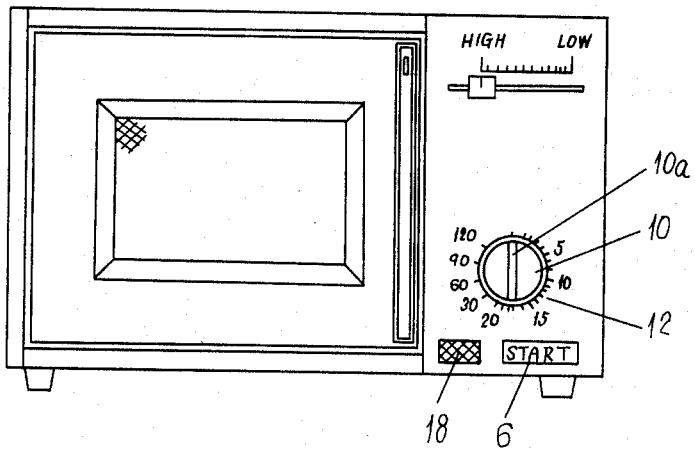
FIG. 13 is a front view of a heating appliance for cooking according to a third example of the embodiments.
Figure 14:
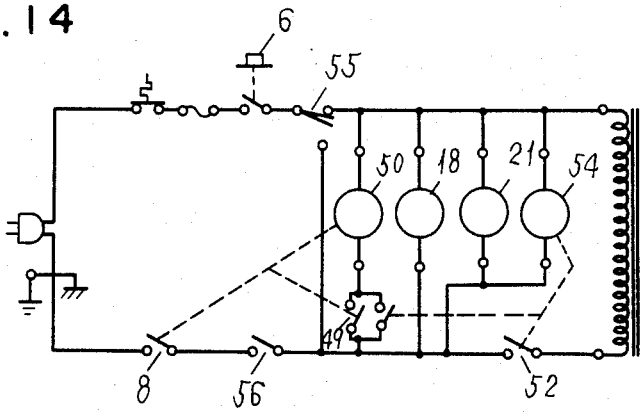
FIG. 14 is a control circuit diagram of the same appliance.

A third embodiment is described below with reference to FIGS. 13 and 14, in which a cam is mounted on a steplessly variable motor 54 which can change the output of the high frequency generation unit freely from low output to high output, and the timer selector switch 49 and intermittent switch 52 are turned on and off by this cam. Numeral 8 denotes a time switch which is interlocked with the timer setting operation, and 55, 56 are door switches interlocked with the opening and closing of the door 3.

According to the heating appliance for cooking of this embodiment, the following effects are obtained.

(1) Since a timer 10 of one speed can be used as a two-speed timer depending on the purpose of use by a simple construction, the timer 10 is mass producible, and heating appliance for cooking with stable quality can obtained.

(2) By use of a one-speed timer 10 as a two-speed one, it is simple to handle, easy to use, and advantageous in enhancement of assembling efficiency.

(3) By arbitrarily varying the rotating speed of the timer motor 50, the setting of timer gradiations may be freely designed.

(4) By changing over the rotating speed of the timer motor by means of intermittent switch 52, the output operation of the heating means can be adjusted from low output to high output, so that cooking and heating according to the menu is possible.

POSSIBILITIES OF INDUSTRIAL USES

By using the heating appliance for cooking of this invention, as described above, an inexpensive one-speed timer may be used as a two-speed timer depending on the purpose of a use by a simple structure of cam and intermittent switch, so that the enhancement of mass producibility of timers and stability of quality can be achieved, thereby providing heating appliances for cooking which require a reduced mounting space and which are easy to handle.

It is evident, needless to say, that it may be widely expanded and developed in appliances having similar timers.

What is claimed is:

1. A heating appliance comprising:

a heating compartment for containing an object to be heated;

a heating means for heating the object in said compartment;

a power supply;

a steady power supply connecting means connected between said power supply and said heating means;

an intermittently operable power supply means connected between said power supply and said heating means in parallel with said steady power supply connecting means for intermittently supplying power and connectable to said heating means;

switching means for switching between the connection of the steady power supply connecting means and the intermittently operable power supply means to said heating means;

an electrically driven heating time control means settable for controlling the operating time of said heating means;

a drive means for setting said heating time control means;

a cam driven by said heating time control means and a lever engaged by said cam; and a changeover switch operated by said lever and connected with said intermittently operable power supplying means and said time control means and also between said power supply and said time control means for changing the power supply to said time control means from an intermittent power supply to a continuous power supply after the passage of a predetermined time of operation of said time control means;

whereby the power supplied to the time control means is intermittently varied through said intermittently operable power supplying means to drive said time control means at a slower speed and then at a higher speed after the operation of said changeover switch by said lever driven by said time control means.

2. A heating appliance as claimed in claim 1 wherein the length of the arm of said lever between said cam and the fulcrum is longer than between the fulcrum and the change-over switch.

3. A heating appliance as claimed in claim 1 in which the angle formed by the point of engagement of said lever with said cam, the fulcrum and the point of engagement of the lever with said changeover switch is at least 90°.

4. A heating appliance as claimed in claim 1 in which said intermittently operable power supplying means is an openable and closeable switch, and said heating appliance further comprising a fan motor for driving a fan for cooling the inside of said heating compartment, said fan motor being connected to said openable and closeable switch for opening and closing said switch.

* * * * *